US007347147B2

(12) United States Patent
Bär et al.

(10) Patent No.: US 7,347,147 B2
(45) Date of Patent: Mar. 25, 2008

(54) BRAKING DEVICE FOR A TRAJECTORY-CORRECTABLE SPIN-STABILIZED ARTILLERY PROJECTILE

(75) Inventors: Klaus Bär, Lauf (DE); Karl Kautzsch, Schwanstetten (DE)

(73) Assignee: Diehl BGT Defence GmbH & Co. KG, Überlingen (DE)

( * ) Notice: Subject to any disclaimer, the term of this patent is extended or adjusted under 35 U.S.C. 154(b) by 272 days.

(21) Appl. No.: 10/527,306

(22) PCT Filed: Sep. 10, 2003

(86) PCT No.: PCT/EP03/10021

§ 371 (c)(1),
(2), (4) Date: Mar. 9, 2005

(87) PCT Pub. No.: WO2004/031682

PCT Pub. Date: Apr. 15, 2004

(65) Prior Publication Data

US 2005/0258308 A1 Nov. 24, 2005

(30) Foreign Application Priority Data

Sep. 13, 2002 (DE) ..... 102 42 588

(51) Int. Cl.
*F42B 10/50* (2006.01)
*F42B 10/14* (2006.01)

(52) U.S. Cl. ..... 102/473; 244/3.27

(58) Field of Classification Search ..... 102/501, 102/529, 473, 490, 498, 385, 388; 244/3.27, 244/113, 3.29, 3.1, 3.21, 3.23, 3.24, 3.25, 244/3.26, 3.28

See application file for complete search history.

(56) References Cited

U.S. PATENT DOCUMENTS

| | | | | |
|---|---|---|---|---|
| 3,047,259 | A * | 7/1962 | Tatnall et al. | 244/138 A |
| 3,114,315 | A * | 12/1963 | Trump | 102/388 |
| 4,726,543 | A * | 2/1988 | Stessen | 244/3.1 |
| 4,860,660 | A * | 8/1989 | Synofzik et al. | 102/501 |
| 5,033,384 | A * | 7/1991 | Eckel et al. | 102/386 |
| 5,108,046 | A * | 4/1992 | Chaumette et al. | 244/110 D |
| 5,237,925 | A * | 8/1993 | Vogt et al. | 102/386 |
| 6,511,016 | B2 * | 1/2003 | Bar et al. | 244/3.24 |
| 6,672,536 | B2 * | 1/2004 | Bar et al. | 244/3.27 |
| 2001/0039898 | A1 * | 11/2001 | Bar et al. | 102/501 |

FOREIGN PATENT DOCUMENTS

| | | | |
|---|---|---|---|
| EP | 1288608 | A1 * | 3/2003 |
| GB | 2337804 | A * | 12/1999 |

* cited by examiner

*Primary Examiner*—James S Bergin
(74) *Attorney, Agent, or Firm*—Scully, Scott, Murphy & Presser, P.C.

(57) ABSTRACT

In order to move a textile braking element (16) which is in the form of an annular disk and which is deployed radially under the effect of centrifugal force rapidly into a contour which is stable in respect of shape and which is always properly defined even under afflux flow conditions, a cloth (33) which is cut in the form of a circular ring is provided by virtue of radially extending tucks or darts, with a reduced outside periphery (32) in such a way that the opening movement is thereby limited to the shape of a flat obtuse-angled hollow truncated cone which, by means of reinforcing bands (34) which are sewn on along generatrices of the frustoconical surface, is pivotably mounted to the holding ring (15) at the inside periphery (31) while along the outside periphery (32), it is provided with a peripherally extending accumulation of mass (29) for increasing the centrifugal deployment forces; wherein in the front end region of the stowage space (14), the ring (15) is axially fitted into the contour of the fuse (12), in such a way as to temporarily slip relative to the projectile spin.

4 Claims, 2 Drawing Sheets

BRAKING DEVICE FOR A TRAJECTORY-CORRECTABLE SPIN-STABILIZED ARTILLERY PROJECTILE

BACKGROUND OF THE INVENTION

Field of the Invention

The invention concerns a braking arrangement which includes braking elements which are radially deployable from a storage space in the fuse region of the ogive of a trajectory-correctable artillery projectile, and is located under a hood which can be blown off or expelled.

The technical object of the present invention is to develop a braking arrangement of the general kind set forth, in such a way that on the one hand there is a perceptibly enhanced braking effect with on the other hand stable ballistics during initiation of the braking arrangement.

That object is based on the realisation that a star-shaped arrangement of radially extensible braking segments, in spite of the turbulence phenomena in the gaps between the braking segments, still does not afford the desirable braking coefficients for a transition, which is as well-defined and quick as possible, from the ballistic launch trajectory into a steepened descent trajectory. The braking effect can admittedly be improved if the free wedge shapes between the individual braking segments are spanned by cloths which are of an acute-angled triangular configuration and which upon launch from the piece of artillery are initially still folded together with the braking segments into the stowage space under a holding hood and are then released with the hood being blown off for centrifugal force-assisted deployment; however the combination of braking segments which are pivotably mounted in a hinge-like fashion and textile portions which are spanned therebetween is extremely complicated and expensive to assemble and in addition suffers from the disadvantage that, by virtue of being compactly pressed in the stowage space, local mechanical loads and stresses can result in region-wise damage to the textile portions filling the gaps. As it is in any case critical for all those gap fillers to be totally tensioned at the same time by the outward pivotal movement of the braking segments which are in the form of a casing shell, so that no asymmetrical afflux flow forces can occur and can result in uncontrollable deflection from the previous trajectory, disruptions of that kind are no longer to be avoided at all if the triangular cloth portions are locally damaged and thus produce a braking characteristic which deviates from the standard one, in unpredictable sectors around the projectile ogive.

SUMMARY OF THE INVENTION

In accordance with the invention the above-outlined object is attained in that the hitherto discrete braking segments are spread out practically to afford an integral textile arrangement of the shape of a circular ring which surrounds the ogive and which implements a shallow obtuse-angled hollow truncated cone and having a small base facing forwardly. In essence, each braking element which peripherally extends without a gap, is in the form of a textile screen which by virtue of its outside periphery, which is reduced with respect to its radius, is deployable only into a flat obtuse-angled frustoconical shape, which is pivotally mounted to a holding ring with its smaller base which faces forwardly in the direction of flight in the front region of the storage space.

BRIEF DESCRIPTION OF THE DRAWINGS

For a more detailed description of the invention, its advantages and developments, reference is directed, besides the appendant claims, also to the description hereinafter of a preferred embodiment of the braking arrangement according to the invention, which is diagrammatically shown in the drawing, being restricted to what is essential in highly abstracted form but approximately true to scale. In the drawing:

DETAILED DESCRIPTION OF THE INVENTION

Figure 1:
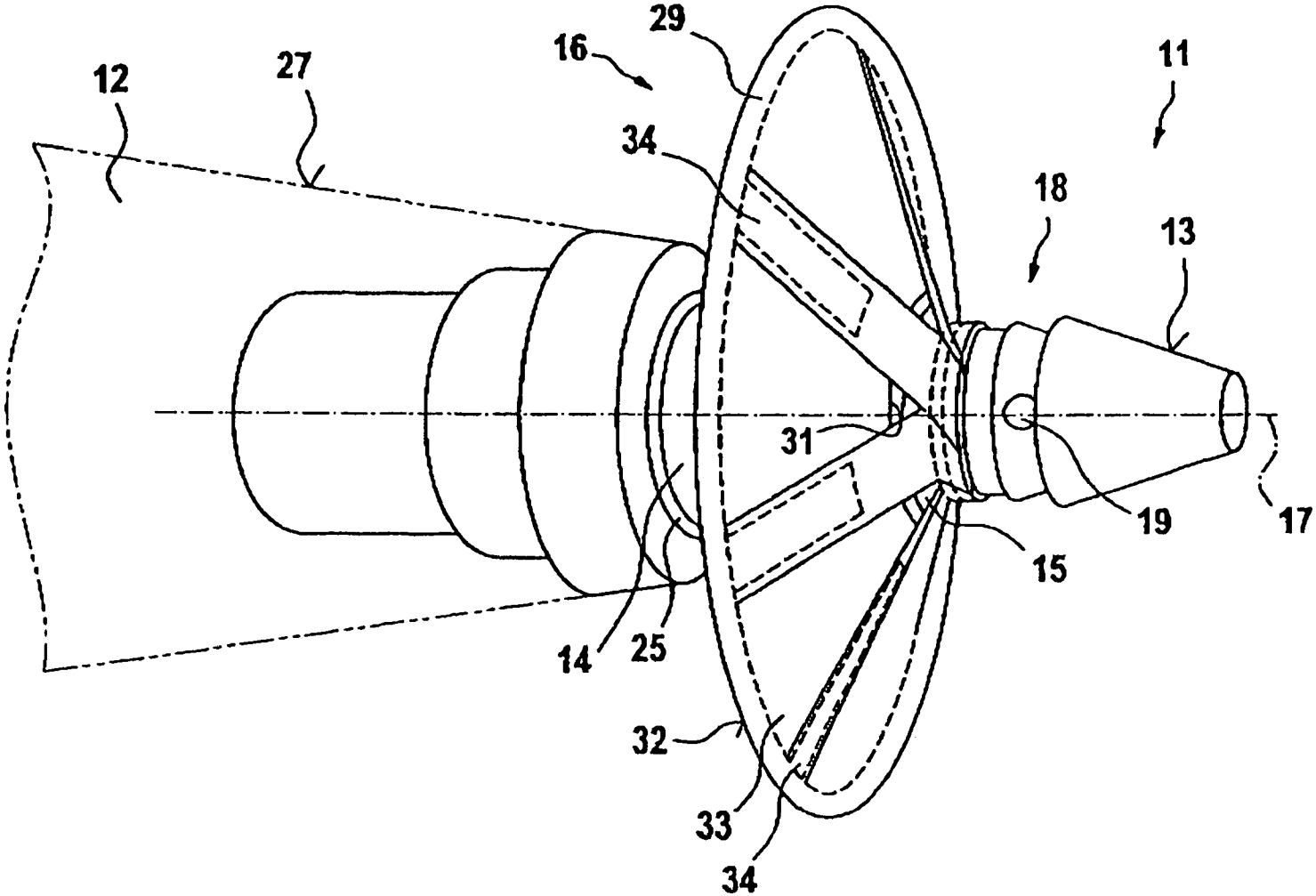
FIG. 1 shows a fuse mounted in the ogive region on an artillery projectile, for warhead triggering, showing a textile braking element in the form of an annular cloth portion, in the deployed condition.
Figure 2:
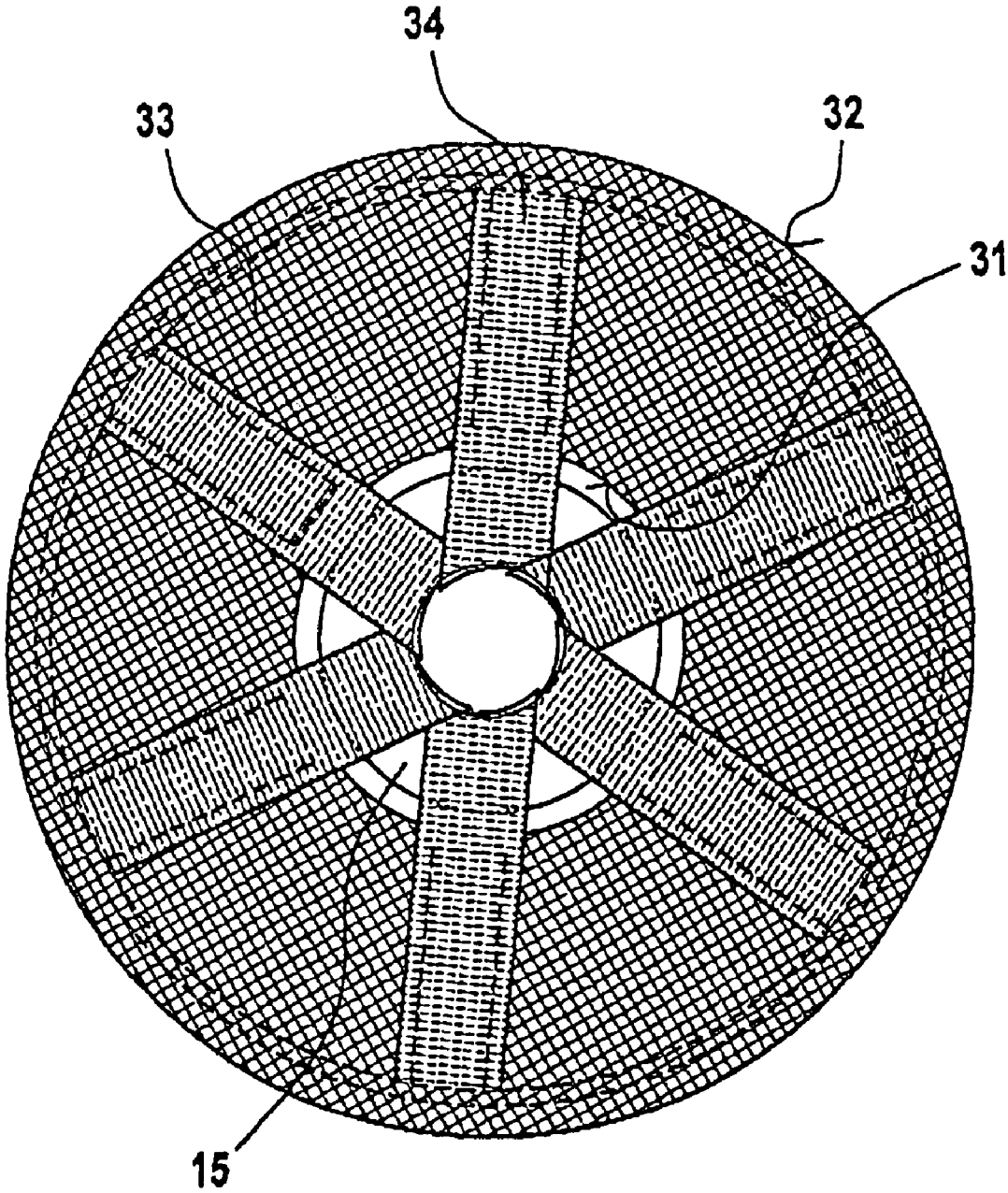
FIG. 2 shows an end view of the braking element as such.

As shown in greater detail in the main patent a fuse 11 which is designed to be screwed into the ogive of an artillery projectile 12 has, in its frustoconical peripheral surface 13, a stowage space 14 which is arranged in peripherally extending radially recessed relationship. In axially opposite relationship to its rear wall 25, that is to say in the direction of flight in front of the stowage space 14, the stowage space 14 carries a ring 15 to which there is pivotally connected the inner periphery 31 of a braking element which in the operative position extends peripherally in coaxial relationship in the form of a circular disk, in the shape of a textile canopy or screen 16 which can be spread open in opposite relationship to the direction of flight. In its storage and launch position that textile braking element is folded from the ring 15 rearwardly uniformly around the longitudinal axis 17 of the projectile into the stowage space 14 and has a hood engaging thereover, until it is released by virtue of the hood being blown off, for radial deployment, under the effect of centrifugal force, into the screen or canopy shape. So that the Coriolis force which occurs in that radial deployment movement with rotation of the projectile 12 in the region of pivotal mounting of the braking element to the ring 15 can be specifically and targetedly reduced, it is desirable, in regard to the axial clamping of the ring 15, to allow temporary rotation relative to the projectile 12 until the reduction in forces results in the termination of that slippage.

The hood which engages over the peripherally extending stowage space 14 with the braking element folded therein, to complete the contour of the conical peripheral surface 13 of the fuse 11 adjoining the outside peripheral surface 27 of the projectile 12, is in the form of a thick-wall hollow cylinder at the front, in front of the small base of the braking screen 16. That hollow cylinder is integrally adjoined in a rearward direction by a wall in the form of a hollow truncated cone, which in contrast is very thin. That thin-walled region is structurally designed to break up in parallel relationship with the axis as far as the cylinder along desired-rupture locations extending in front of same, into individual shell portions which then lift radially away from the rotating stowage space 14 under the influence of centrifugal force. For that purpose, as in the main patent, the shank of a mushroom-shaped mounting 18 for a plurality of radially acting pyrotechnic force elements 19 which are distributed uniformly over the periphery engages from the front, therefore in opposite relationship to the direction of flight, axially through the hollow cylinder of the hood and through the pivotal mounting ring 15 into a socket in the mechanical structure of the fuse 11. The force elements 19 which are thereby caused to bear against the inside periphery of the hollow cylinder serve upon firing to cause the hollow cylinder of the hood, which is disposed on the mounting means 18, to be radially blown open and thus cause that cover hood to be lifted off the stowage space 14, being broken up into defined portions.

The radial pyrotechnic loading on the hollow cylinder which rests on the mounting means 18, at the front end of the launch hood, therefore results in removal of the stowage space wall and thus liberation of the braking screen 16 which now opens out in the form of an annular disk quickly and in a stable shape under centrifugal force from the stowage space 14 around the ring 15 as its smaller base of the truncated cone configuration, assuming an operative position which is not entirely orthogonal with respect to the axis 17.

That centrifugal force-induced deployment of the braking screen 16 in the form of the annular disk is also promoted by virtue of the fact that—in opposite relationship to the pivot mounting to the ring 15—the screen is provided with a defined accumulation of mass 29 at least by hemming seams but possibly also by sewing in reinforcing portions, in comparison with the surface of the cloth, in order to increase the moment of inertia for fast stable deployment out of the inwardly folded position into the final position which is predetermined from the cut, in the interests of affording a rapidly effective, large, symmetrical afflux flow surface to provide a maximum braking action.

As diagrammatically shown in the drawing therefore the braking screen 16 which is referred to as such herein but which also has an afflux flow against its outside peripheral surface essentially involves a textile assembly surrounding the fixing ring 15 in the form of an annular disk. It will be noted however that from the point of view of its cut the textile assembly is designed under the influence of centrifugal force not to be opened out into a textile disk which is substantially flat and therefore at risk of fluttering, but only as far as a relatively large angle with respect to the axis 17 of the projectile, in order always to be able to stably maintain the same frustoconical geometry in the condition of maximum deployment, without flutter phenomena along the edge. For that purpose, the cloth 33 of the screen 16, which is cut in a circular round configuration in a plane, is gathered up in the peripheral direction with radial sector cuts or sewing seams along narrow cut-outs, in such a way that the outside periphery of the screen 16, in its frustoconically deployed operative position, is less than the circumference of the circle with respect to the radius. That results in a mechanically stable and geometrically defined, frustoconical braking screen 16 which under the effect of an afflux flow is caused to billow out in a uniform fashion all around; the braking screen 16 is oriented in the direction of flight and its small base is therefore also disposed at the mounting means 18 with the ring 15 while the large base is oriented from there rearwardly, towards the projectile 12.

That wide braking screen 16 in the form of an annular disk can be pivotably mounted with its cloth 33 looping directly around the ring 15 along the inside diameter of the cloth 33. It is however more desirable for the cloth 33 to be sewn in a spoke or radius form to reinforcing bands 34 which are also textile and which on the one hand adjoin the outside periphery 32 and extend from there radially beyond the inside periphery 31 as far as the ring 15 whose outside diameter is somewhat smaller than that of the inside periphery 31. Thus the cloth 33 which is in the form of a circular ring and which is deployed in a frustoconical configuration is only bound to the ring 15 by means of the reinforcing bands 34, which promotes uniform deployment upon issuing from the stowage space 14 and reliably prevents damage to the cloth 33 upon initially slippage movement of the ring 15.

In order therefore to move the textile braking element 16 which is deployed radially under the effect of centrifugal force rapidly into a contour which is stable in respect of shape and which is always properly defined even under afflux flow conditions, a cloth 33 which is cut in the form of a circular ring is provided by virtue of radially extending tucks or darts, with a reduced outside periphery 32 in such a way that the opening movement is thereby limited to the shape of a flat obtuse-angled hollow truncated cone which, by means of reinforcing bands 34 provided along generatrices of the frustoconical surface, is pivotably mounted to the holding ring 15 at the inside periphery 31 of the small base which faces forwardly in the direction of flight, bridging over a radial spacing, while rearwardly, along the outside periphery 32, it is provided with a peripherally extending accumulation of mass 29 for increasing the centrifugal deployment forces; wherein in the front end region of the stowage space 14, the ring 15 is axially fitted into the contour of the fuse 12, in such a way as to temporarily slip relative to the projectile spin.

The invention claimed is:

1. A braking arrangement comprising a braking element which is radially deployable from a stowage space (14) located in the fuse region of an ogive of a correctable-trajectory artillery projectile (12) below a hood which is adapted to be blown off from said projectile, said braking element extending peripherally unitarily and gaplessly in a circumferential direction upon deployment from said stowage space (14), said braking element being in the form of a textile screen (16) comprised of a cloth (33), which is cut in a circular round configuration in a plane and is gathered up in a peripheral direction with selectively radial sector cuts or sewing seams or with radially extending tucks or darts, such that said textile screen (16), by virtue of said cloth being gathered up in the peripheral direction, is prevented from being opened out into a substantially flat textile disk but is resultingly adapted to deploy only into an obtuse-angled frusto-conical shape and thereby is always able to stably maintain said frusto-conical shape in a condition of maximum deployment; and wherein said textile screen (16) in a front region of said stowage space (14) is pivotably mounted with a smaller base of its frusto-conical shape to a holding ring (15), said smaller base facing forwardly in the direction of flight of the projectile.

2. A braking arrangement as set forth in claim 1, wherein the screen (16) is provided with radially extending reinforcing bands (34) which are wrapped around the holding ring (15), bridging over an internal radial spacing between an inside periphery (31) of the screen and the holding ring (15).

3. A braking arrangement as set forth in claim 1, wherein the holding ring (15) is axially gripped into the contour of a fuse (11) in the fuse region so as to be rotatable with respect to the spin of the projectile (12).

4. A braking arrangement as set forth in claim 1, wherein the outside periphery (32) of the screen (16) is provided with an additional weight of a mass (29).

* * * * *